US010744393B2

(12) United States Patent
Duch

(10) Patent No.: US 10,744,393 B2
(45) Date of Patent: Aug. 18, 2020

(54) GOALTENDER DEVICE WITH WRIST BAND AND CORD FOR RETRACTABLE SUPPORT OF A REMOVED GOALIE GLOVE

(71) Applicant: David Duch, Winnipeg (CA)

(72) Inventor: David Duch, Winnipeg (CA)

( * ) Notice: Subject to any disclaimer, the term of this patent is extended or adjusted under 35 U.S.C. 154(b) by 112 days.

(21) Appl. No.: 16/029,998

(22) Filed: Jul. 9, 2018

(65) Prior Publication Data

US 2019/0022511 A1 Jan. 24, 2019

(30) Foreign Application Priority Data

Jul. 20, 2017 (CA) ..... 2974326
Nov. 1, 2017 (CA) ..... 2984256

(51) Int. Cl.
*A63B 69/00* (2006.01)
*A63B 71/14* (2006.01)
*A63B 102/24* (2015.01)

(52) U.S. Cl.
CPC ..... *A63B 71/143* (2013.01); *A63B 69/0026* (2013.01); *A63B 2102/24* (2015.10); *A63B 2209/00* (2013.01); *A63B 2210/50* (2013.01)

(58) Field of Classification Search
CPC ..... A41D 13/08; A41D 13/081; A41D 9/015; A63B 71/143
See application file for complete search history.

(56) References Cited

U.S. PATENT DOCUMENTS 4,159,792 A * 7/1979 Siegal ..... A41D 19/0041 224/267
2009/0271916 A1* 11/2009 Harris ..... A63B 71/12 2/456
2011/0265243 A1* 11/2011 Kaplan ..... A41D 19/0041 2/160
2014/0289930 A1* 10/2014 Moss ..... A63B 71/146 2/161.4
2018/0255848 A1* 9/2018 Moreau ..... A41D 19/0037
2019/0192955 A1* 6/2019 Hammer ..... A63B 71/143

FOREIGN PATENT DOCUMENTS

| | | |
|---|---|---|
| EP | 0288663 | 11/1988 |
| GB | 2241869 | 9/1991 |
| GB | 2512097 | 9/2014 |

* cited by examiner

*Primary Examiner* — Katherine M Moran
(74) *Attorney, Agent, or Firm* — Kyle R Satterthwaite; Ryan W Dupuis; Ade & Company Inc.

(57) ABSTRACT

A goaltender device features a cord; a wrist strap attached or attachable to a first end of the cord; and a clip attached or attachable to a second end of the cord for selective attachment of a goalie glove thereto. During use, the goaltender temporarily removes their goalie glove to expose the glove hand for use in a two-handed grip on a goal stick, during which the goalie glove hangs on the cord from said glove arm of the goaltender. The goaltender then uses a thrusting movement of the glove hand arm to pulling the glove back up to the glove hand via the cord.

3 Claims, 2 Drawing Sheets

GOALTENDER DEVICE WITH WRIST BAND AND CORD FOR RETRACTABLE SUPPORT OF A REMOVED GOALIE GLOVE

CROSS-REFERENCE TO RELATED APPLICATIONS

This application claims benefit under 35 U.S.C. 119(a) of Canadian Patent Application No. 2,974,326, filed Jul. 20, 2017, and Canadian Patent Application No. 2,984,256, filed Nov. 1, 2017, the entireties of which is incorporated herein by reference.

FIELD OF THE INVENTION

The present invention relates generally to hockey equipment, and more particularly to a goaltending device usable with a goalie glove.

BACKGROUND

In hockey, when a goalie wants to make a two-handed pass or shot, the ability to do so is hampered by goalie glove or "trapper" worn on the goalie's glove hand.

Accordingly, it would be desirable to provide a device for assisting a goalie's ability to make a confident two-handed pass or shot.

SUMMARY OF THE INVENTION

According to one aspect of the invention, there is provided a goaltender device comprising a cord; a wrist strap attached or attachable to a first end of the cord; and a clip attached or attachable to a second end of the cord for selective attachment of a goalie glove to the cord via said clip.

According to another aspect of the invention, there is provided a goaltender device comprising: a cord; a wrist strap attached or attachable to a first end of the cord; and a goalie glove attached or attachable to a second end of the cord.

According to yet another aspect of the invention, there is provided a goaltending method comprising: with a first end of a cord connected to a worn item on a glove hand arm of a goaltender and a second end of said cord connected to a goalie glove worn on said glove hand, temporarily removing said goalie glove to expose the glove hand of the goaltender for use in a two-handed grip on a goalie stick, during which the goalie glove hangs on the cord from said glove arm of the goaltender, and then using a thrusting movement of the glove hand arm, pulling the glove back up to the glove hand via the cord.

BRIEF DESCRIPTION OF THE DRAWINGS

One embodiment of the invention will now be described in conjunction with the accompanying drawings in which.

DETAILED DESCRIPTION

The appended drawing shows a goaltender device featuring a strap 10 for securing in a worn position around the wrist of a goaltender's glove hand arm, and an elastic shock cord 12 with a pair of snap clips 14*a*, 14*b* attached the opposing first and second ends of the cord 12. The wrist strap 10 features a series of grommeted eyeholes 16 which serve as selectable attachment points for the first snap clip 14*a* in order to connect the shock cord 12 to the wrist strap. By selecting from the among the different eyeholes 16, one can select how far the elastic shock cord 12 will hang from the wrist. The second snap clip 14*b* located at the opposite end of the shock cord is clipped onto a goalie glove or "trapper" (not shown).

The device allows the hockey goalie to dislodge the trapper glove from the glove hand on which it is normally worn, so the goalie can then hold onto the goalie stick more effectively and efficiently with both hands. During this two-handed gripping of the stick, the glove is suspended by the cord that hangs from the wrist strap to which it is clipped. The glove should hang in a position just touching the ice, which requires proper adjustment of the cord's hanging length through selection from among the different grommeted attachment points on the wrist band.

Figure 1:
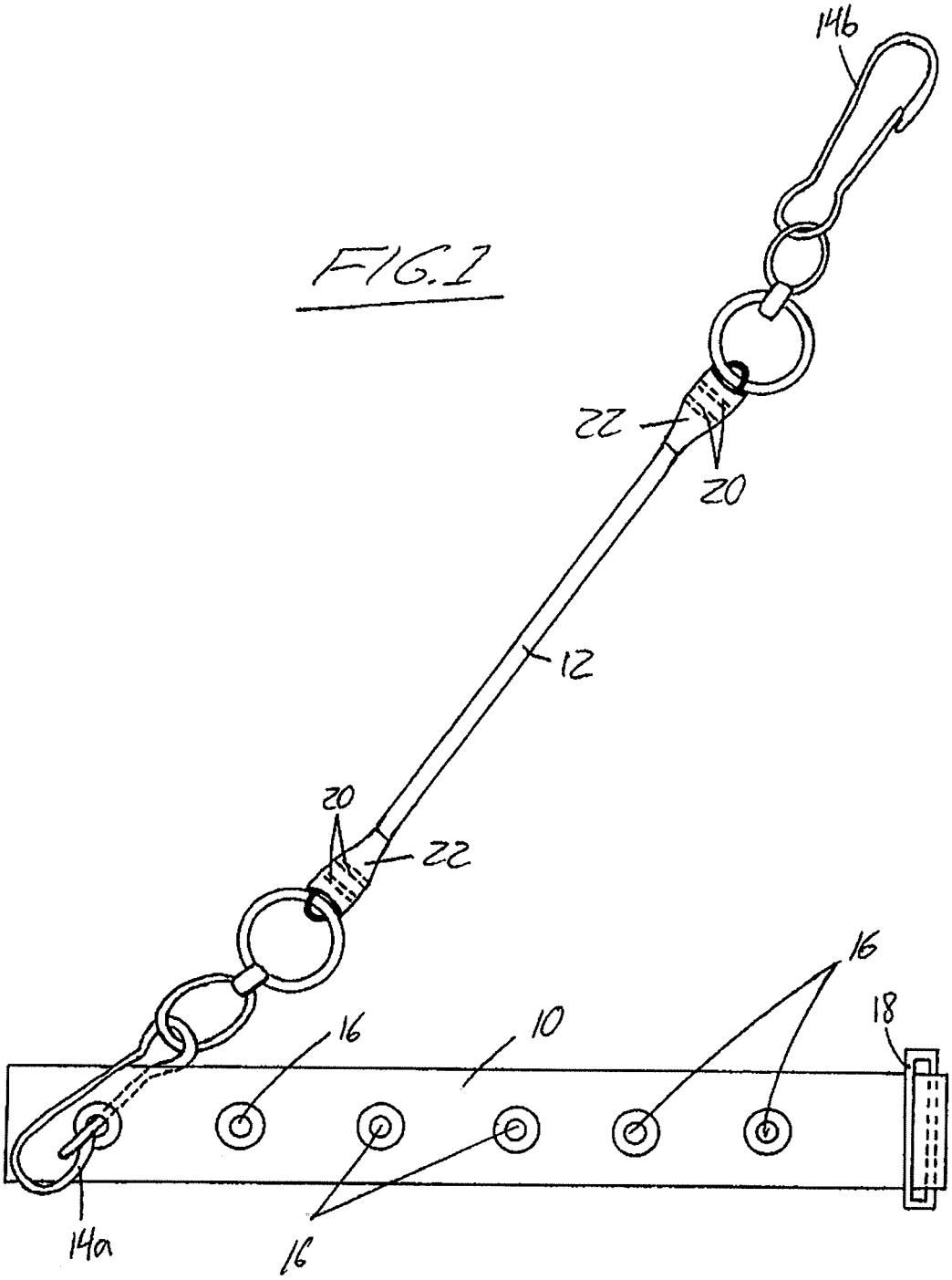
FIG. 1 illustrates a goaltender device for retractable hanging of a goalie glove from the wrist of a goaltender's glove hand arm.
Figure 2:
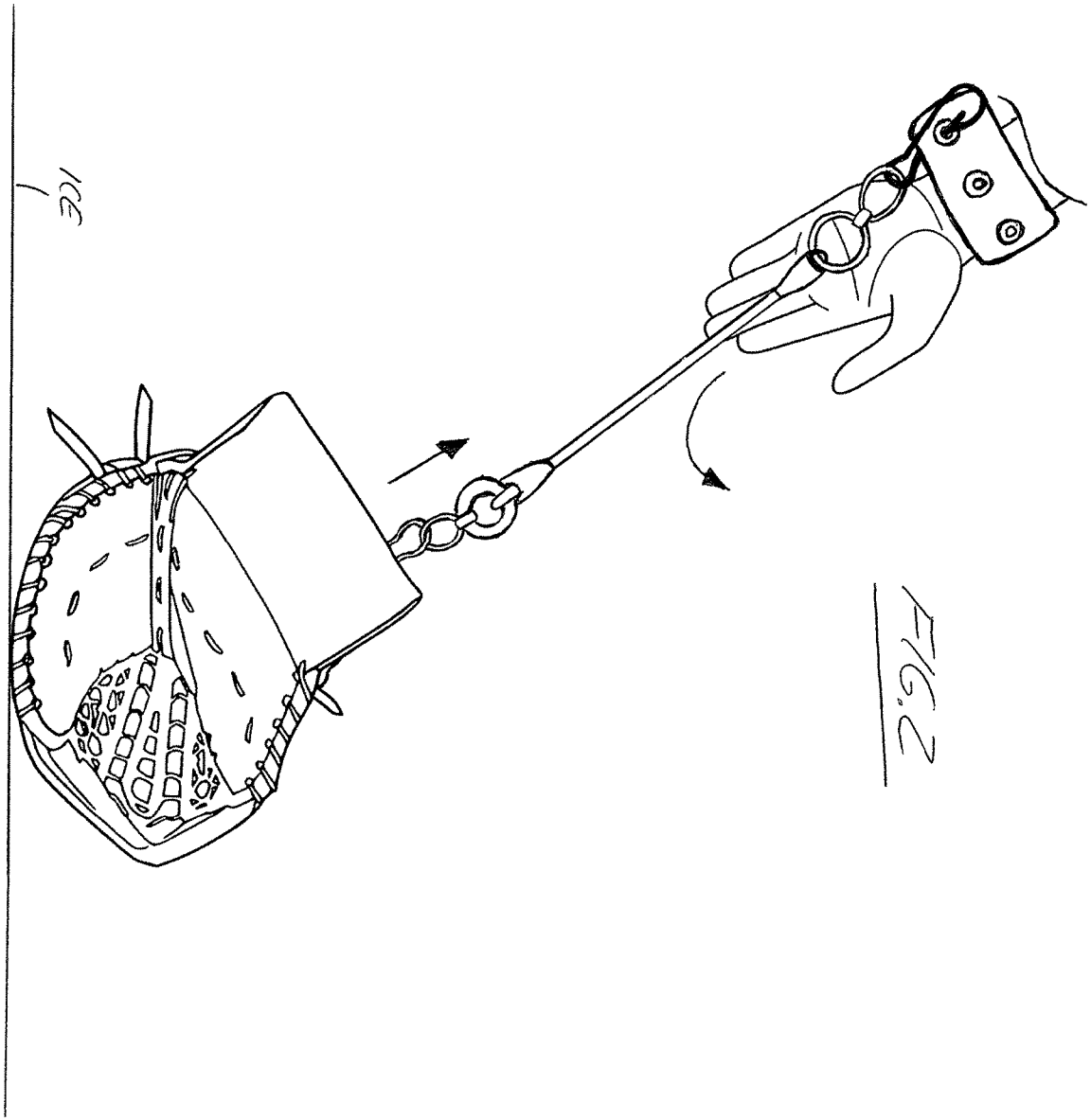
FIG. 2 illustrates use of the goaltender device to retractably hang the goalie glove from the goaltender's wrist.

After the goalie makes a two-handed pass or takes a two-handed shot, he/she can then retract the glove back up to the glove hand, where he/she can then clutch the trapper and put it back on with ease. As shown in FIG. 2, this retraction of the glove is performed with a slight forward thrust and upward pull of the glove hand arm on which the wrist strap is worn, which through the shock cord, will retract the glove back in the grip of the goaltender's glove hand. The elasticized shock cord helps provide a recoil back to the goalie's glove hand. This allows the process of dislodging the glove and recoiling it back on the hand quicker and easier. It is an easy smooth action and with very little practice, one can have the glove off and back on the hand in a manner of seconds or less. Using the device correctly, the tip (end) of the trapper should be just touching the ice, just enough to take some of the pressure/weight off of the wrist. This avoids any tightening of the strap on the wrist under the weight of the trapper hanging on the cord.

One possible construction of the device is described as follows, though it will be readily appreciable that the particular sizes and materials selected may be varied without detraction from the general structure and operation of the device. In the exemplary construction, there are: two stainless-steel clips 14*a*, 14*b*, one of which is attached to the goalie's glove (not shown); one wrist strap approximately fourteen inches long, with six brass grommeted eye holes for attachment of the second clip 14*b* to the strap 10 through any selected one of these eye holes, and one ladder lock 18 sewn on the end of the strap so the wrist strap can loop around through it; one 6.5-inch shock cord 12 that is 0.25-inch in diameter; four one-inch hog rings 20, and two pieces of 0.25-inch diameter shrink wrap 22 each measuring 0.75-inches long. The hog rings 20 are secured to the shock cord 12 after looping through the ring area of the stainless-steel clips 14*a*, 14*b*. There are two hog rings 22 per stainless steel clip, and they are fastened on with hog ring pliers. This ensures that when there is pressure placed on the ends of the stainless-steel clips 14*a*, 14*b*, they will remain secured. The shrink wrap pieces 22 are slipped on prior to placing the hog rings 20 on, and once the hog rings 20 are secured, the shrink wrap sleeves 22 are placed over the hog rings. The shrink wrap ensures that no material becomes caught on the ends of the hog rings, and provides an aesthetically pleasing appearance concealing the ring connections.

Potential benefits of the device include increased overall performance due to the goalie's ability to better secure/ control the puck; improved goalie ability, power and accuracy in shooting and/or passing the puck; and reduction in the labour-intensive process of training goalies how to shoot, as compared to shooting with the trapper on. This valuable training time can be better spent on other skills, physical conditioning, and more team-involved aspects of practice. The device has the potential to change the dynamics of the game by making all goalies more capable of puck handling that can provide more transitional involvement in the game. It may help reduce "dump and chase" type play, or introduce additional challenges to such tactics. The goalie maintains the independent choice of whether to use the device or not, even when worn. The device also has the potential to create a more positive atmosphere in the goalie's mind because they are more involved in the play, and it adds to the new element of surprise, unpredictability, team involvement, and social contentedness.

Since various modifications can be made in my invention as herein above described, and many apparently widely different embodiments of same made, it is intended that all matter contained in the accompanying specification shall be interpreted as illustrative only and not in a limiting sense.

The invention claimed is:

1. A goaltending method comprising:

with a first end of a cord connected to a worn item on a glove hand arm of a goaltender and a second end of said cord connected to a goalie glove worn on said glove hand, temporarily removing said goalie glove to expose the glove hand of the goaltender and making a two-handed shot or pass with a goalie stick, during which the goalie glove hangs on the cord from said glove arm of the goaltender, and then, solely through a singular thrusting movement of the glove hand arm, pulling the glove back onto the glove hand via the cord.

2. The method of claim 1 wherein said cord is elasticized.

3. The method of claim 1, wherein the method is performed on a sheet of ice, and comprises hanging the goalie glove in a position contacting the ice while the goalie glove is removed from the glove hand such that at least a partial weight of the goalie glove is borne by the ice rather than the glove hand arm of the goaltender.

* * * * *